United States Patent [19]

Yen et al.

[11] 4,045,313

[45] Aug. 30, 1977

[54] ELECTROLYTIC RECOVERY FROM BITUMINOUS MATERIALS

[75] Inventors: Teh Fu Yen, Altadena; Chaur-Shyong Wen, Los Angeles, both of Calif.

[73] Assignee: The University of Southern California, Los Angeles, Calif.

[21] Appl. No.: 716,859

[22] Filed: Aug. 23, 1976

[51] Int. Cl.[2] ..... C25B 3/02

[52] U.S. Cl. ..... 204/131

[58] Field of Search ..... 75/101 BE; 204/130, 204/131

[56] References Cited

FOREIGN PATENT DOCUMENTS 147,834 2/1921 United Kingdom ..... 204/131

*Primary Examiner*—R. L. Andrews

*Attorney, Agent, or Firm*—Nilsson, Robbins, Dalgarn & Berliner

[57] ABSTRACT

Chemical products are obtained by oxidative electrolysis of an electrolytically active slurry of bituminous material and alkaline electrolyte.

10 Claims, 3 Drawing Figures

ELECTROLYTIC RECOVERY FROM BITUMINOUS MATERIALS

FIELD OF THE INVENTION

The invention relates to the recovery of chemicals from bituminous material and, more specifically, from oil-bearing shale and its derivatives.

BACKGROUND AND SUMMARY OF THE INVENTION

Oil shale is a natural sedimentary rock containing an abundance of residual organic material which, when processed, can be made into oil and fuel products. Typically, oil shale, such as exemplified by the Green River formation in Wyoming, Colorado and Utah, has about 15-20% organic material embedded in an inorganic mineral matrix. The organic portion is composed generally of a soluble bitumen fraction and an insoluble fraction in which kerogen constitutes the bulk of the insoluble organic material. The bitumen fraction is readily solubilized by organic solvents and can be removed for refinement by physical means. The kerogen portion is characterized by its insolubility in organic solvents and is therefore more difficult to remove. In Green River oil shale, kerogen makes up about 75% of the organic components and in most all oil shale is the major organic component.

Crude shale oil is quite different from petroleum and in some respects may be considered to be intermediate in composition between petroleum and coal tar, containing significantly higher concentrations of some hetero compounds than are found in "petroleum fractions". Other properties such as high carbon to hydrogen ratio, high percentage of hydrogen content and large amounts of nonhydrocarbon organic material prevent the common refining processes developed by the petroleum industry from being efficiently applicable to the recovery of chemicals from shale oil. The oxidation of oil shale can yield valuable hydrocarbons which can be readily converted to useful products such as diesel fuel. Attempts have been made to recover chemical products from oil shale components and their derivatives by using harsh chemical oxidizing agents such as potassium permanganate. However, large scale operations also yield vast amounts of spent by-products, such as manganese dioxide, resulting in impurities in the product and causing significant environmental problems. Other chemical oxidants are generally uneconomic. Accordingly, chemical oxidation techniques are of only limited value.

The usual method of processing oil shale comprises crushing the matrix rock and subjecting the crushed matrix to heat in a retort to distill off the kerogen by destructive pyrolysis. However, the process degrades otherwise valuable chemical components of the kerogen. When the oil shale is destructively pyrolyzed, it yields a black, waxy material from which an asphaltene fraction can be recovered, containing considerable quantities of olefinic hydrocarbons and nitrogen-, sulphur- and oxygen-containing compounds. The asphaltene fraction in crude oils and refinery bottoms is well know in the petroleum industry and is generally recognized as the transition stage from fossil fuel source to oil. Accordingly, the economic conversion of shale oil to useful products should take into account the effective conversion of asphaltene.

The present invention provides a process for the recovery of chemicals from bitumenous material which is efficient and which does not adversely affect the environment. The process involves subjecting the bituminous material to oxidative electrolysis and separating and recovering water-soluble products from the resultant residue. Specifically, an electrolytically active slurry of the bituminous material and alkaline electrolyte is placed in the anode chamber of a cell having a cathode chamber electrol tically operative therewith. A direct current potential is applied across the anode and cathode chamber at a current density of above about 15 $A/m^2$ for a time sufficient to effect substantial oxidative electrolysis of the bituminous material, yielding a water-soluble product and a residue. The water-soluble product is separated from the residue to yield desirable chemical products.

The process applies to the electrolytic oxidation of carbonaceous bitumens in general, including coal and tar sands as well as oil shale. With respect to oil shale, the process can be applied to the hydrocarbon fraction contained in both the solvent soluble organic portion (bitumen) and the generally insoluble organic portion (kerogen) and can be applied to the asphaltene fraction derived from shale oil as well as directly to leached oil shale.

DETAILED DESCRIPTION

The following description will relate, for exemplification, to processing in an industrial plant environment. However, it is to be understood that oxidative electrolysis as described herein is also applicable directly to the shale formation in situ, i.e., to shale deposits in the ground. In such case, an electrolytic cell can be defined by the appropriate placement of anodes and cathodes in such deposits. Accordingly, the process as defined herein is meant to include such broader considerations.

Figure 1:
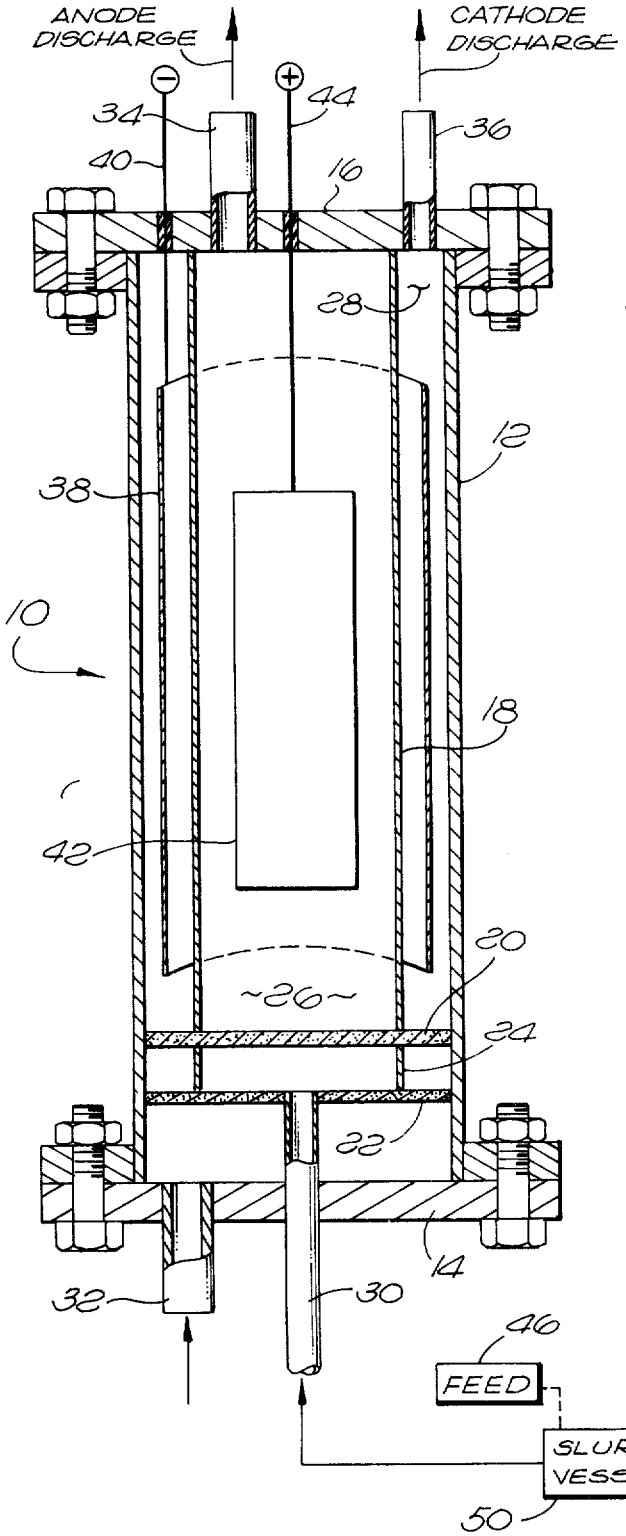
FIG. 1 is a cross-sectional view of a form of continuous cell useful in conducting the present electrolytic process.

Referring to FIG. 1, a co-flow continuous cell 10 is illustrated. The cell 10 comprises a tubular outer shell 12, the ends of which are closed by bottom and top walls 14 and 16, respectively. An elongate, tubular, rigid porous alundum diaphragm 18 is supported within and spaced from the outer shell 12 on a pair of top and bottom distributor plates 20 and 22, respectively, spaced one from the other by a short spacer ring 24. The bottom distributor plate is secured spaced from the inner surface of the bottom shell wall 14. The top end of the diaphragm 18 abuts the inner surface of the top shell wall 16 to define an anode chamber 26 therewithin and a cathode chamber 28 between its outer surface and the inner surface of the shell 12. The diaphragm 18 has a porosity range of about 50μ to 100μ, is sufficiently porous to permit the flow of electricity therethrough, but is substantially impermeable to the oil shale sample.

A sample inlet tube 30 extends through the bottom shell wall 14 and bottom distributor plate 22, into the space below the top distributor plate 20. An electrolyte inlet tube 32 also extends through the bottom shell wall 24 but terminates below the bottom distributor plate 22.

The top shell 16 is fitted with a sample outlet tube 34 and electrolyte outlet tube 36. The sample outlet tube 34 is located so as to serve as an anolyte outlet from the anode chamber 26. The electrolyte outlet tube 36 is located so as to serve as a catholyte outlet from the cathode chamber 28.

The top distributor plate 20 is sufficiently porous, e.g., 550μ to 1000μ, to permit easy flow of feed material slurry into the anode chamber 26. The bottom distributor plate 22 is sufficiently porous to permit easy flow of electrolyte but is preferably substantially impremeable to the feed slurry, e.g., about 10μ to 75°. During operation, flow is constant, toward the outlets, but during interruptions, the bottom distributor plate 22 limits back-flow of feed slurry into the cathode chamber. Modifications can be made which, while departing from optimum operation, nevertheless provide a workable process.

Figure 2:
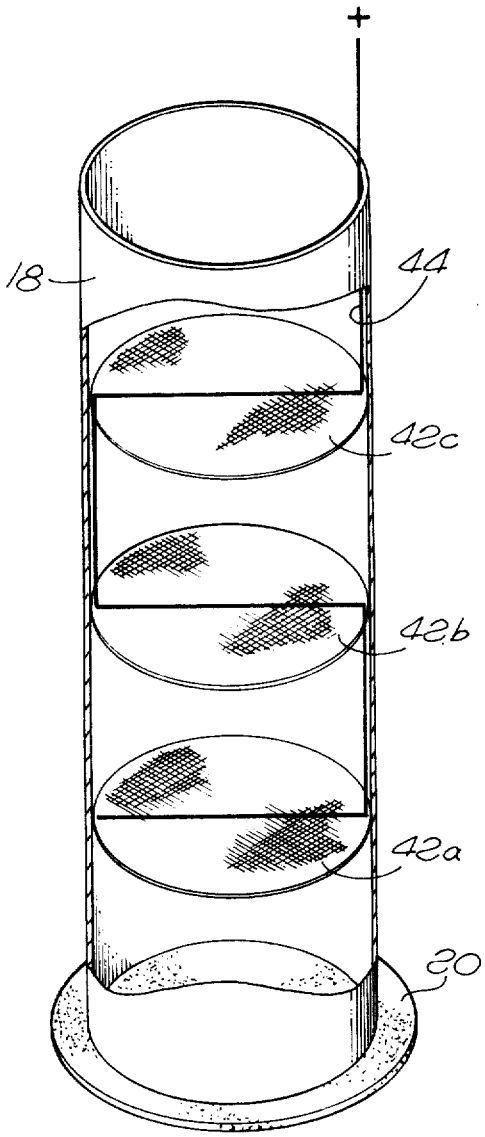
FIG. 2 is a perspective, partially cut-away view of the anode chamber of the continuous cell of FIG. 1.

A lead sheet cathode 38, rolled around but spaced from the diaphragm 18, is sealed in the cathode chamber through the upper shell wall 16 by means of a copper wire 40. Referring additionally to FIG. 2, an anode (shown schematically at 42 in FIG. 1) is defined by three circular discs 42*a*, 42*b* and 42*c*, each formed of 45 mesh platinum gauze horizontally secured within the diaphragm and soldered with a length of copper wire 44 in S shape and sealed through the upper shell wall 16.

Feed material 46 and aqueous alkaline electrolyte 48 are fed into a slurry vessel 50 where they form an electrolytically active slurry. The feed material, as utilized herein, is in the form of ground oil shale, kerogen concentrate therefrom, bitumen extract from oil shale, asphaltene diffraction derived from shale oil, or the like. The bituminous material is ground to a particle size preferably smaller than 60 mesh U.S. Standard, a suitable range being about 60 to 326 mesh U.S. Standard. It is preferred that slurrying take place under at least agitated conditions such as is caused by a rotating impeller, or under grinding or pulverizing conditions such as would occur if the slurrying vessel were a ball mill. In the latter case, grinding and slurrying could take place simultaneously and such would be particularly applicable to the slurrying of raw oil shale.

As feed material, in the broader aspects of the invention, one can use various oil shales, coals, tar sands and other carbonaceous bitumens or organic materials therefrom such as kerogen, bitumen, asphaltene, or the like. The present process is particularly suitable for application to oil shales and derivatives thereof.

An oxidative environment is provided by the use of an alkaline electrolyte, preferably in a concentration of greater than 1.0 N. The electrolyte can be used up to saturation but generally an upper concentration of about 0.1 N is satisfactory. As an economic electrolyte, one can use an alkali metal hydroxide such as NaOH or KOH.

The slurry of feed material and alkaline electrolyte solution from the slurry vessel 50 is pumped through the sample inlet tube 30 into the anode chamber 26 while alkaline electrolyte is fed through the electrolyte inlet tube 32. Alternatively, feed material in high concentration can be slurried only with water and then pumped through the sample inlet tube 30 to be mixed with alkaline electrolyte solution in the space between the top and bottom distributor plates. Anolyte and catholyte are withdrawn from the outlet tubes 34 and 36. The catholyte can be led back to the electrolyte inlet tube 32 in closed-loop fashion.

The current density of the applied potential generally should be above about 15 amperes per square meter and can range up to 300 A/m$^2$. Dwell time in the electrolyte cell should average at least about 2 hours at the upper level of current density to several days if necessary at the lower levels, depending of course upon electrolyte composition, particle size of the feed, nature of the feed material and operating temperature.

Although the process has been illustrated utilizing platinum anodes, for large commercial installation, carbon anodes and lead sheet cathodes are preferred. Other electrodes can be used which are resistant to the electrolyte solution. An electricl potential is applied by means of a suitable source therefor connected to the anode lead 44 and cathode lead 40.

Figure 3:
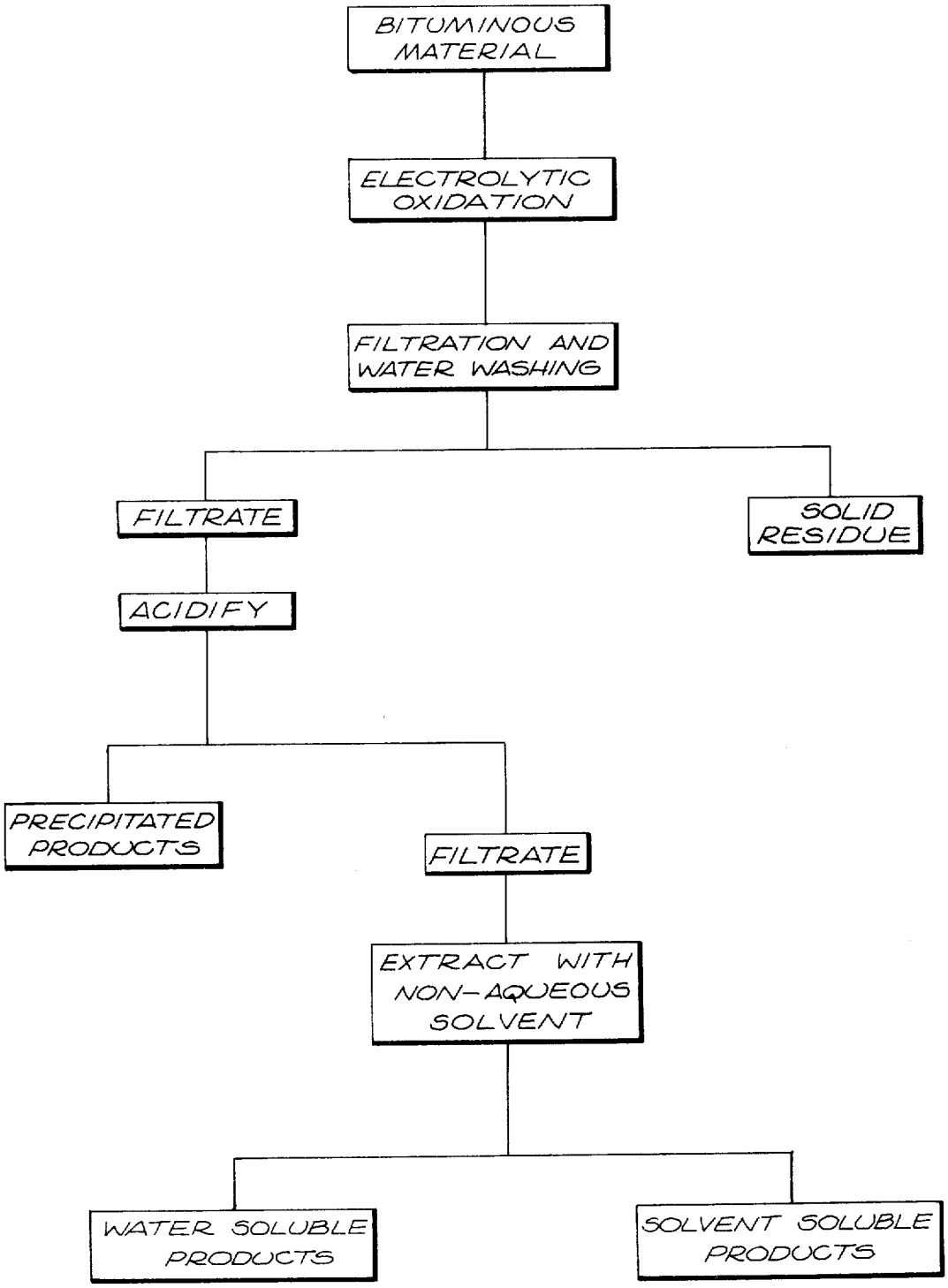
FIG. 3 is a flow diagram exemplifying separation of products of electrolysis from resultant residue.

Oxidative electrolysis of the feed material results in the formation of a variety of water soluble products and a residue. Isolated oxidation products appear mainly as homologues of normal carboxylic, dicarboxylic and branched aliphatic carboxylic acids with some saturated fatty alcohols also being identifiable in the product. Separation and recovery of products is illustrated in FIG. 3. Following oxidative electrolysis of the bituminous material, the product is filtered and washed and the filtrate separated from the solid residue. The filtrate is acididified, for example with hydrochloric acid, to yield a precipitate which can be recovered as a product. The filtrate from the acification is extracted with a non-aqueous solvent such as carbon tetrachloride to separate and yield, by evaporation, water soluble products and solvent soluble products. All of the products are useful petrochemical materials.

The following examples, in which all parts are by weight, will illustrate application of the process.

EXAMPLE 1

A kerogen concentrate was prepared from a raw sample of hydrocarbon-rich Green River oil shale (from the Mahogony Ridge formation). The oil shale was ground to pass a 150 mesh screen, U.S. Standard, and 10 parts were leached with 100 parts of 7.4% hydrochloric acid for 24 hours, resulting in a weight loss of about 33%. The leached material was Soxhlet extracted with a mixture of benzene:methanol (4:1) for 48 hours to remove the soluble bitumen.

65 Parts of the resultant residue were treated with 50 milliliters of a 1:1 by volume mixture of concentrated hydrofluoric acid (48%) and hydrochloric acid (37%). The mixture was filtered and the residue was washed repeatedly with boiling water until the filtrate was neutral. The residue was then dried at 75° C in an oven for 8 hours. to obtain a kerogen concentrate.

Electrolytic oxidation of the kerogen concentrate was carried out using an H-type cell of 150 milliliter total capacity. One-half of the H-type cell defined an anode compartment while the other half defined a cathode compartment separated from the anode compartment by a porous frit in the horizontal connecting conduit of the H-type cell. An anode was formed of 45 mesh copper, 5cm × 10cm (Cambridge Wire Cloth Co., Cambridge, Md.) supported within the anode chamber by a 20 B&S gauge copper wire leading through a cement seal in the neck of the cell. A lead sheath (12 centimeters square) served as the cathode and was connected by means of a platinum wire through a cement seal in the neck of the cathode chamber. The anode wire was connected through an ammeter to one side of a voltage adjuster while the cathode wire was connected to the other side of the voltage adjuster. A voltmeter was connected across the anode and cathode wires.

500 milligrams of the above kerogen concentrate were placed in the anode compartment along with a magnetic stirrer. A total of 100 milliliters of 3 N sodium hydroxide solution was added to the anode and cathode compartments to fill to the same levels. Oxidative electrolysis was conducted by applying a direct current of 5 $Ma/cm^2$ (50 $A/m^2$). The current density was maintained constant throughout each run by adjustment of the potential, which was in the range of 3 to 7 volts.

Upon completion of the electrolysis, the contents of the anode chamber were filtered and washed well with hot water. The aqueous layer was acidified with 20% hydrochloric acid to a pH of 1.2 to yield 20 milligrams of a precipitate and 300 milligrams of residue. The precipitate was esterified with $BF_3$ in methanol and extracted with heptane. The filtrate resulting from the foregoing precipitation was extracted with carbon tetrachloride. The heptane extracted esterified precipitate and the carbon tetrachloride extracted product were each analyzed by gas chromatography. Prior to $BF_3$ esterification, a portion of the precipitated product was subjected to thermal chromatographic analysis as was a portion of the solid unoxidized residue. Gas chromatographic analysis was conducted on 10 feet × ⅛inch glass columns packed with 3% silicon gum rubber on Chromosorb Q and 5% Carbowax 20M on Chromosorb W. Thermal chromatography was carried out by an MP-3 thermal chromatography unit with heating at 40° C/min. to 620° C with a thermal conductivity detector, the effluent gases being trapped and back-flushed and analyzed by gas chromatography.

The thermogram of unoxidized kerogen obtained from the Green River formation is known to have a sharp peak at 480° C (D. A. Scrima, T. F. Yen, and P. L. Warren, "Thermal Chromatography of Green River Oil Shale. I. Bitumen and Kerogen" Energy Sources, vol. 1, no. 3, page 321, 1974), which represents the decomposition of kerogen at this temperature. For the solid unoxidized residue, following the foregoing oxidative electrolysis, the initial decomposition temperature occurred at 280° C followed by a second break-down peak at 375° C and a small third peak at 420° C. All of these peaks are lower than that of the decomposition temperature of kerogen concentrate. Gas chromatography of the effluent trapped gas showed that almost all hydrocarbons had been oxidized and had disappeared except for only some low boiling point materials which could be attributed to products being adsorbed on the surface of the solid unoxidized residue.

The thermogram of the precipitated product had a peak at 110° C indicating water removal and some easily decomposed products. Two peaks were found at 170° C and 250° C attributable to water-soluble carboxylic acid. A trailing peak at 430° C was found which could belong to water insoluble long chain aliphatic acids. The gas chromatogram of the $BF_3$ esterification of the precipitated product showed a predominance of $C_{14}$ to $C_{22}$ monocarboxylic acids and $C_{12}$ dibasic acid.

The carbon tetrachloride filtrate extract was found by gas chromatography to contain two fractions of product. A lower boiling fraction appears to be due to the oxidation of short-chain components that are cross-linked on the outside of the kerogen. An infrared spectrum of the carbon tetrachloride extract showed a strong ester absorpotion band, COC stretching of ether bonds, an aromatic CH stretching band and out-of-plane CH bending of 3, 4 and 5 adjacent aromatic ring hydrogen atoms.

EXAMPLE 2

A sample of the Green River oil shale of Example 1 was ground to pass a 150 mesh screen, U.S. Standard, and leached with 7.4% hydrochloric acid for 24 hours, in the manner referred to in Example 1. In similar manner, the leached material was Soxhlet extracted with a mixture of benzene-methanol (4:1) for 48 hours. Removal of the benzene/methanol solvent from the extract yielded oil shale bitumen which served as the reactant for oxidation.

Oxidative electrolysis of the bitumen was carried out using the H-type cell referred to in Example 1 except that the anode was formed of 45 mesh platinum gauze (2.5 × 5 cm; Fisher Scientific Co., Pittsburgh, PA) rolled into a cylinder and supported within the anode chamber by a platinum wire leading through the cement seal in the neck of the cell. A solution of 1.5 grams of the bitumen extract in 10 milliliters of benzene was placed in the anode compartment along with a magnetic stirrer. A total of 90 milliliters of 3N sodium hydroxide was added to both the anode and cathode compartments to fill to the same level in the two compartments. The mixture was kept well stirred with the magnetic stirring bar while a current density of 10 $Ma/Cm^2$ (100 $A/m^2$) was maintained constant throughout the process by adjustment of the potential, which was in the range of 3 to 7 volts. After 15 hours of oxidative electrolysis, the contents of the anode chamber were filtered and washed well with hot water. The aqueous layer was acidified with 20% hydrochloric acid to pH 1.2 to yield a precipitate. The filtrate from the precipitation was extracted by carbon tetrachloride to obtain solvent-soluble products, leaving water-soluble products in the filtrate.

A portion of the original bitumen extract was redissolved in benzene and injected into a gas chromatography 5feet × ⅛inch stainless steel column, packed with 5% silicon rubber XE 60 on Chromsorb G. The gas chromatogram showed phytane ($C_{20}$) as a predominate compound. The sterone and triterpane isomers were also present in major fractions. A perhydro-$\beta$ carotene peak was also evident. After 15 hours of the foregoing oxidative electrolysis, the residue (non-oxidized material) of bitumen was dissolved in benzene and analyzed by gas chromatography. The chromatogram showed that all the foregoing bitumen components were oxidized except for a small amount of isoprenoids.

250 Milligrams of the precipitate and 860 milligrams of residue were obtained. The precipitate was esterified with $BF_3$ and analyzed by gas chromatography. A great many peaks were found representing dibasic acids and cyclic fatty acids derived from isoprenoids and steroid compounds. The hydrocarbon products from the carbon tetrachloride extraction of the electrolyzed filtrate showed two major peaks at $C_{16}$ and $C_{28}$ (n-alkanes) as well as four peaks which can be attributed to the outside short chains of bitumen structure. Esterification of this fraction showed acid peaks around $C_{14}$ and $C_{16}$ fatty acids.

EXAMPLE 3

Oil shale from the Anvil Point of the Green River formation was ground to pass a 150 mesh U.S. Standard screen and leached with 7.4% hydrochloric acid for 24 hours in the manner described in Example 1, resulting in a weight loss of 33%. A sample of 2.0 grams of the leached material was subjected to oxidative electrolysis in the manner described with respect to the kerogen concentrate of Example 1, for 25 hours. The separation and analysis of various fractions were worked up as described in Example 1.

A gas chromatogram of the heptane soluble compound from the $BF_3$ esterification of the oxidized precipitated products showed the precipitated products to be composed of saturated monocarboxylic acids in a range of $C_{10}$–$C_{22}$, normal dicarboxylic acids in the range of $C_6$–$C_{11}$, and branched aliphatic carboxylic acids. Gas chromatographic analysis of the carbon tetrachloride extract of the water-soluble filtrate showed a number of peaks, some of which were identified as saturated fatty alcohols from $C_{14}$ (1-tetradecanol) to $C_{20}$ (1-eicosanol). Identification of peaks was accomplished by co-injection of known standards and by comparison of the chromatographic retention time of each compound with those of standard kits.

The elemental analysis of the original leached oil shale and solid residue is shown in Table 1 below and indicates that about 76.3% of the organic hydrocarbons were oxidized and dissolved in the electrolyte solution.

TABLE 1

| Composition | Carbon, wt. % | Hydrogen, wt. % | Ash, wt. % |
|---|---|---|---|
| Original leached oil shale* | 41.7 | 4.65 | 54.3 |
| Residue from 25 hr. electrolysis | 9.46 | 1.59 | 85.4 |

*Based on 33% weight loss.

EXAMPLE 4

An asphaltene sample was prepared from 200 grams of crude shale oil which was suspended in 4000 milliliters of n-pentane. After stirring the mixture well, the asphaltene precipitate was centrifuged and washed out from the pentane soluble fraction. The precipitate was then Soxhlet extracted with pentane until the extraction was clear, requiring about ten hours. The solid residue was then twice suspended in benzene, filtered and reprecipitated in n-pentane. Finally, this solid was lyophilized in benzene, freeze-dried and then ground into a fine powder. The amount of asphaltene obtained was about 3 grams out of the 200 grams of crude shale oil. Oxidative electrolysis was conducted in a cell having 3 compartments separated by 2 cation membranes (Nafion, sold by DuPont) between a central anode and two outer cathode compartments. A platinum gauze, 5 centimeters square, was used as the anode and two 3 × 6 centimeter lead sheets served as cathodes. A one gram sample of asphaltene was placed in the anode compartment along with an aqueous solution of 3N sodium hydroxide for a total amount of 50 milliliters to an even level in the three compartments. Electrolysis was conducted under a current density maintained at 6Ma/cm$^2$ (60 A/m$^2$) by adjustment of the potential, which was in the range of 1 to 3 volts.

Electrolysis took 10 hours following which the contents of the anode chamber were filtered and washed well with water. The solid asphaltene residue was reextracted by n-pentane, followed by benzene to provide a final residue of oxidized asphaltene amounting to approximately 28% of the original asphaltene. The properties of the residue are similar to the original asphaltene based on its infrared spectrum and esterified gas chromatagram analysis. The n-pentane extracted fraction from the residue of the oxidized asphaltene showed a strong dominant peak of $C_{25}$ n-alkane upon gas chromatographic analysis.

The aqueous filtrate was acidifed as described with respect to the work-up in Example 1, to pH 1.5 to yield a precipitate constituting about 13% of the original amount of asphaltene. gas chromatographic analysis of the precipitate after esterification showed a series of carboxylic acids in which $nC_{12}$ and $nC_{16}$ acids were dominant.

After removal of the precipitate, the remaining acidified solution was freeze-dried and then extracted by n-pentane. The distribution of n-alkane in this pentane soluble fraction ranged from $C_{14}$ to $C_{15}$ with $C_{23}$ being dominant. Finally, the residue from the n-pentane extraction was extracted with benzene to yield 8% of benzene soluble material and 2% of benzene insoluble, water soluble materials based on the original amount of asphaltene. The benzene soluble fraction was esterified and analyzed by gas chromatography showing $nC_{12}$ to $nC_{32}$ acids with the $nC_{16}$ carboxylic acid dominant.

The foregoing results indicate that over 65% of the original shale oil asphaltene was converted to fatty acids and pentane soluble material after oxidative electrolysis of the asphaltene. These derivatives are useful as valuable raw materials. The distribution of the n-alkanes and carboxylic acids from electrolytic oxidation of shale oil asphaltene is shown in Table 2.

TABLE 2

| | n-Alkane | | n-Carboxylic Acid | |
|---|---|---|---|---|
| Carbon Number | Pentane-Extract From Oxidized Residue | Pentane-Extract From Aqueous Product | ppt Product | Benzene-Extract From Aqueous Product |
| C-10 | — | — | 0.51 | — |
| C-11 | — | — | 0.72 | — |
| C-12 | — | — | 1.00 | 0.20 |
| C-13 | —0.42 | 0.01 | | |
| C-14 | — | 0.10 | 0.41 | 0.13 |
| C-15 | 0.01 | 0.07 | 0.09 | 0.02 |
| C-16 | 0.04 | 0.16 | 0.48 | 1.00 |
| C-17 | 0.05 | 0.85 | 0.06 | 0.09 |
| C-18 | 0.03 | 0.15 | 0.21 | 0.39 |
| C-19 | 0.06 | 0.07 | 0.14 | 0.13 |
| C-20 | 0.02 | 0.05 | 0.15 | 0.43 |
| C-21 | 0.02 | 0.08 | 0.33 | 0.20 |
| C-22 | 0.10 | 0.19 | 0.15 | 0.51 |
| C-23 | 0.12 | 1.00 | 0.15 | 0.30 |
| C-24 | 0.04 | 0.18 | 0.05 | 0.22 |
| C-25 | 1.00 | 0.20 | 0.04 | 0.27 |
| C-26 | 0.25 | 0.11 | 0.07 | 0.29 |
| C-27 | 0.04 | 0.15 | 0.02 | 0.23 |
| C-28 | 0.02 | 0.25 | 0.10 | 0.27 |
| C-29 | 0.06 | 0.43 | 0.04 | 0.28 |
| C-30 | 0.02 | 0.40 | 0.18 | 0.36 |

TABLE 2-continued

| Carbon Number | n-Alkane | | n-Carboxylic Acid | |
|---|---|---|---|---|
| | Pentane-Extract From Oxidized Residue | Pentane-Extract From Aqueous Product | ppt Product | Benzene-Extract From Aqueous Product |
| C-31 | 0.03 | 0.50 | 0.01 | 0.29 |
| C-32 | 0.03 | 0.49 | 0.08 | 0.16 |
| C-33 | 0.02 | 0.42 | — | — |
| C-34 | — | 0.32 | — | — |
| C-35 | — | 0.22 | — | — |

Various modifications, changes and alterations can be made in the present process and its steps and parameters. All such modifications, changes and alterations as are within the scope of the appended claims form part of the present invention.

We claim:

1. A process for treating bituminous material for recovery of chemicals therefrom, comprising:

slurrying said material with an aqueous alkaline electrolytic solution;

defining an electrolytic cell having a cathode chamber electrolytically operative with an anode chamber, an anode in said anode chamber in contact with said slurry and a cathode in said cathode chamber; and applying a direct current potential across said anode and cathode chambers at a current density of above about about 15 $A/m^2$ for a time sufficient to effect substantial oxidative electrolysis of said material whereby to obtain a water-soluble product, and a residue, therefrom; and separating said water-soluble product from said residue.

2. The process of claim 1 in which the electrolyte in said slurry is an hydroxide of a metal.

3. The process of claim 1 in which said slurry has an electrolyte concentration of greater than 1.0 N.

4. The process of claim 1 in which said bituminous material contains kerogen as its major organic component.

5. The process of claim 4 in which said bituminous material comprises a kerogen concentrate obtained by extraction of organic solvent-soluble bitumen, and leaching of carbonate minerals, from oil shale.

6. The process of claim 1 in which said bituminous material comprises bitumen as its major organic component.

7. The process of claim 1 in which said bituminous material comprises leached oil shale as its major organic component.

8. The process of claim 1 in which said bituminous material comprises asphaltene as its major organic component.

9. The process of claim 1 in which said water-soluble product is separated from said residue by filtration of said residue, precipitation of product by acidification of the resultant filtrate and extraction with a non-aqueous solvent of further product from the filtrate resulting from said precipitation.

10. A process for treating raw oil shale for recovery of chemicals therefrom, comprising:

grinding said oil shale to pass at least a 60 mesh screen, U.S. Standard;

adding organic solvent for bitumen to said ground shale to solubilize bitumen in said shale, and extracting said solubilized bitumen;

adding a mineral acid to said extracted shale for leaching carbonate minerals;

washing to remove residual acid and reaction products of said leaching to obtain a kerogen concentrate;

slurrying said kerogen concentrate with a dilute aqueous solution of alkali metal hydroxide as electrolyte at a concentration of greater than 1.0 N;

placing said slurry into the anode chamber of an electrolytic cell having a cathode chamber electrolytically operative with said anode chamber;

applying a direct current potential across said anode and cathode chambers at a current density of at least 15 $A/m^2$ for at least one hour to effect electrolysis of said kerogen concentrate whereby to obtain a water-soluble product, and a residue, therefrom; and separating said water-soluble product from said residue by filtration of said residue, precipitation of product by acidification of the resultant filtrate and extraction with non-aqueous solvent of further product from the filtrate resulting from said precipitation.

* * * * *